United States Patent [19]

Nazet et al.

[11] 4,313,474

[45] Feb. 2, 1982

[54] METHOD FOR THE MANUFACTURE OF A MICROWAVE DELAY LINE AND MICROWAVE DELAY LINE OBTAINED BY THIS METHOD

[75] Inventors: René Nazet; Pierre Ribout, both of Paris, France

[73] Assignee: Thomson-CSF, Paris, France

[21] Appl. No.: 105,507

[22] Filed: Dec. 20, 1979

[30] Foreign Application Priority Data

Dec. 27, 1978 [FR] France ..... 78 36486

[51] Int. Cl.[3] ..... B21F 3/10; B21F 45/00

[52] U.S. Cl. ..... 140/71 R; 29/600; 140/92.1; 315/3.5; 333/162

[58] Field of Search ..... 140/71 R, 71 C, 92.1; 29/60 D; 333/162; 315/3.5

[56] References Cited

U.S. PATENT DOCUMENTS

| | | | |
|---|---|---|---|
| 2,812,499 | 11/1957 | Robertson | 29/60 UX |
| 2,813,221 | 11/1957 | Peter | 315/3.5 |
| 2,955,223 | 10/1960 | Kompfner | 315/3.5 |
| 3,262,769 | 7/1966 | Bauer | 29/600 UX |
| 3,583,065 | 6/1971 | Holland | 29/600 |
| 3,634,786 | 1/1972 | Matsuoka | 333/162 |
| 3,760,223 | 9/1973 | Jasper, Jr. | 315/3.6 |
| 4,004,179 | 1/1977 | Phillips | 315/3.6 X |
| 4,090,280 | 5/1978 | Ormili et al. | 29/600 |

*Primary Examiner*—Howard N. Goldberg
*Attorney, Agent, or Firm*—Roland Plottel

[57] ABSTRACT

The present invention relates to a method for the manufacture of a hyperfrequency delay line. The method comprises using a single metal wire shaped by the coiling thereof, said operation comprising bringing the wire into the form of contiguous coils. Coiling is followed by a wire cambering operation during which the coils are deformed at regular intervals in the axis of the line by using wedges, in such a way that the line is formed by a succession of identical groups of three coils in which the first and third coils have identical but oppositely directed inclinations with respect to the axis and in which half of the second coil remains contiguous with the first coil and half remains contiguous with the third coil. Application to the manufacture of double helix delay lines, of ring and bar and ring and loop lines, used in travelling wave tubes functioning as amplifiers.

6 Claims, 12 Drawing Figures

FIG_1
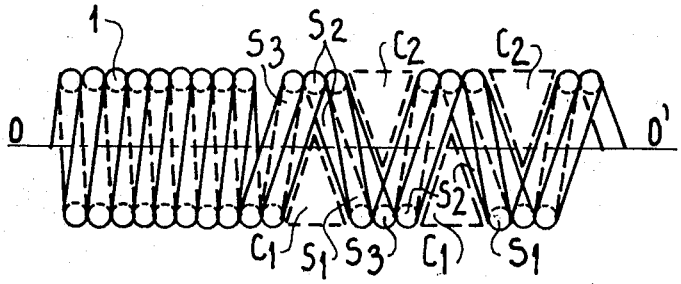
FIG_2
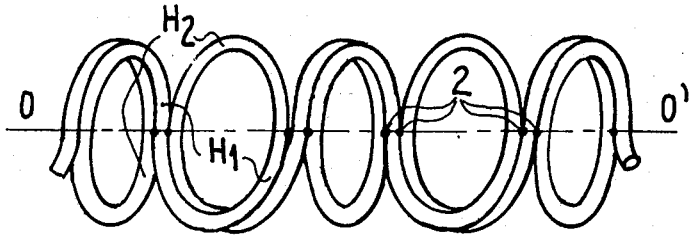
FIG_3-a
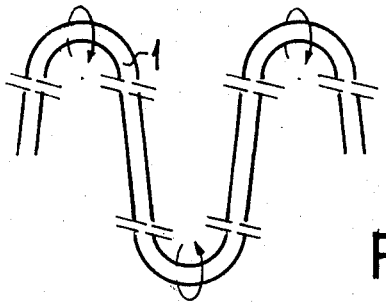
FIG_3-b
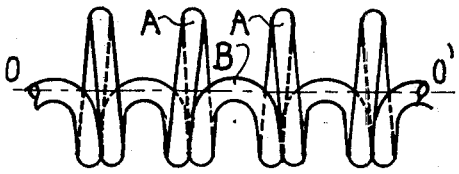
FIG_4
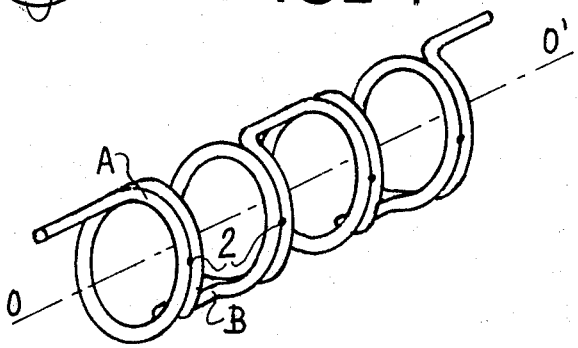

METHOD FOR THE MANUFACTURE OF A MICROWAVE DELAY LINE AND MICROWAVE DELAY LINE OBTAINED BY THIS METHOD

BACKGROUND OF THE INVENTION

The present invention relates to a method for the manufacture of a microwave delay line. It also relates to microwave delay lines obtained by this method and to the travelling wave tubes having said lines.

As is known the delay line associated with a travelling wave tube functioning as an amplifier ensures the interaction between an electron beam focussed along the axis of the line and the fundamental propagation mode of the hyperfrequency travelling wave traversing the line, with a phase velocity close to that of the beam. The electrons transfer energy to the hyperfrequency wave and consequently there is an amplification phenomenon of the microwave energy circulating in the line.

Helical delay lines are conventionally used in travelling wave tubes. The disadvantage of these lines is that they excite oscillations in the travelling wave tubes for powers of the order of a few kilowatts.

Therefore delay lines having a more complicated construction are used and for which the amplitude of the inverse travelling mode of the wave, which causes the oscillation of the travelling wave tube, is reduced compared with that of a helical line. Thus, these lines have a reduced tendancy to bring about the excitation of oscillations of the travelling wave tubes and travelling wave tubes of a few dozen kilowatts have been obtained. Thus, it is possible to use double helix lines, constituted by two identical helixes of the same longitudinal axis coming from the same point and having opposite winding directions. Ring and bar or ring and loop lines are also widely used. They comprise rings arranged perpendicularly to the propagation direction of the electron beam, two successive rings being connected by a bar, giving the ring and bar line, or by a loop, giving the ring and loop line, and two successive bars or loops are diametrically opposed with respect to the rings.

The main disadvantage of double helix delay lines and of ring and bar and ring and loop lines is that they are difficult to construct. Thus, it is known to make double helix lines by welding together two identical helixes, which is very difficult or by milling or the electro-erosion of a cylindrical tube, which is also difficult to carry out. The ring and bar type lines can also be produced by machining a cylindrical tube. Ring and loop lines are generally obtained by using a mechanically or chemically cut metal strip, which is then bent back on itself in alternating manner and with the desired pitch. Problems are encountered if it is necessary to manufacture a line of the ring and loop type by this method using a metal such as tungsten which is difficult to treat mechanically when in the form of a strip, but which is in great demand, mainly due to its refractory characteristics.

BRIEF SUMMARY OF THE INVENTION

The present invention relates to a method for the manufacture of a microwave delay line, which ensures in a travelling wave tube functioning as an amplifier, the interaction between an electron beam focused in the axis of the line and the fundamental propagation mode of the hyperfrequency travelling wave passing through said line with a phase velocity close to that of the beam, the amplitude of the inverse propagation mode of the wave being reduced compared with that of a helical microwave delay line. The method of the invention comprises using a single metal wire shaped by at least one coiling operation of the said wire consisting of bringing the metal wire into the form of coils. Coiling can be preceded by the bending of the metal wire, which consists of giving an arched shape to the wire sections, coiling being performed on each wire section which undergoes bending. Coiling can be followed by the curving or cambering of the metal wire, which consists of deforming the line in a given direction at regular intervals.

The present invention also relates to delay lines and in particular double helix delay lines, ring and bar and ring and loop lines obtained by the method of the invention.

The method of the invention offers numerous advantages, specific reference being made to the following advantages:

It can be used in the manufacture of several lines and particularly double helix, ring and bar and ring and loop lines.

It is simple to perform and only a single metal wire is required for producing complex lines.

The manufacturing procedure is simple and the coiling, bending and cambering operations are known and are made particularly easy by the fact that they are applied to a metal wire and not to a metal plate, as was the case in the prior art. It is also possible to easily produce complex lines made from various metals, such as copper, molybdenum and tungsten.

Through the use of a hollow metal wire the method of the invention makes it possible to obtain delay lines which are cooled by the circulation of fluid within the wire and which can therefore be used in high power travelling wave tubes.

The method of the invention makes it possible to easily obtain complex microwave delay lines having a variable period and whose coils can have a random configuration and a variable development length.

BRIEF DESCRIPTION OF THE DRAWINGS

The invention is described in greater detail hereinafter relative to non-limitative embodiments and with reference to the attached drawings, wherein show:

FIG. 1, a diagram illustrating the manufacturing method according to the invention for a double helix delay line.

FIG. 2, a perspective view of a double helix delay line obtained by the method of the invention illustrated by FIG. 1.

FIGS. 3*a* and *b*, 5 and 7, diagrams illustrating three applications of the manufacturing method according to the invention in the case of a ring and bar delay line.

FIGS. 4, 6 and 8, perspective views of the application of the method to a ring and bar-type delay line obtained by using the method of the invention illustrated by FIGS. 3*a* and *b*, 5 and 7.

DETAILED DESCRIPTION OF THE PREFERRED EMBODIMENTS

Figure 5:
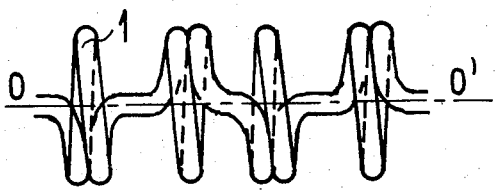

In the drawings the same reference numerals designate the same members but, for reasons of clarity, the dimensions and proportions of the various members have not been respected.

FIG. 1 is a diagram illustrating the manufacturing method according to the invention for a double helix delay line.

The metal wire 1, which can be of random type and cross-section, is firstly brought into the form of contiguous coils during the coiling operation. For this purpose the metal wire is generally wound onto a mandrel, which is subsequently removed. This mandrel is generally cylindrical, but it may also be conical which makes it possible to obtain variable diameter coils, which improves the gain and efficiency of the travelling wave tube.

The left-hand part of FIG. 1 shows the metal wire which has only undergone coiling, whilst the right-hand part shows the metal wire which has already undergone cambering, during which the line is deformed in a direction corresponding to the longitudinal axis 00' of the coils which constitutes the axis of the line. The line can be considered to be formed by a succession of identical groups of three coils, during cambering, the first coil of each group is separated from the two others and the inclination of the three coils with respect to the axis 00' is modified until the first and third coils $S_1$ and $S_3$ have substantially identical, but oppositely directed inclinations compared with the longitudinal axis of coils 00'. Half of the second coil $S_2$ remains contiguous with the first coil and the other half remains contiguous with the third coil. Cambering can be brought about by sliding a wedge, on either side of each first coil $S_1$, perpendicular to the axis 00' and in opposite directions. Wedges $C_1$ and $C_2$ are shown by broken lines in FIG. 1.

FIG. 2 is a perspective view of the double helix delay line obtained by the method of the invention illustrated by FIG. 1. In FIG. 2 $H_1$ and $H_2$ designate the two helixes having opposite winding directions and which constitute the helical line. Preferably there is an electrical connection and a mechanical connection at each intersection point of the two helixes. These connections can be obtained by brazing the metal wire or by welding (e.g. by electron bombardment or by laser). In FIG. 2 the connections 2 are shown symbolically.

FIGS. 3*a* and 3*b* show diagrams illustrating the application of the method of the invention to a ring and bar-type delay line.

FIG. 3*a* shows the bending operation during which an arched shaped is given to the sections of wire 1, two successive sections being arched in opposite directions, so that the wire has a substantially sinusoidal shape.

FIG. 3*b* shows the coiling operation during which the metal wire is brought into the form of coils. Each arc made during the bending operation is coiled towards the axis of the line 00' in such a way as to form two incomplete coils, each representing $\frac{3}{4}$ of a coil and which are joined together by a wire section which is substantially parallel to axis 00' and which constitutes a bar. Two consecutive arcs are coiled towards the axis of line 00' in opposite directions. Each arc therefore forms with the two arcs adjacent thereto two rings A, constituted by one and a half contiguous coils arranged perpendicular to the axis 00' of the line. Each ring is separated from the following ring by a bar B. Two successive bars are diametrically opposed with respect to the rings. A ring and bar line is thus obtained and FIG. 4 is a perspective view of this line. Preferably there is an electrical connection and a mechanical connection on each ring at the point where the one and a half coils constituting the ring is closed. These connections 2 are shown diagrammatically in FIG. 4.

FIG. 5 is a diagram illustrating a second application of the manufacturing method according to the invention for a ring and bar-type delay line. Only the coiling operation is used in this case. The wire is coiled in such a way as to form a ring of one and a half contiguous turns. A bar is then formed by placing a piece of wire parallel to axis 00' of the line. After that another ring is formed by coiling the wire in the same direction.

Figure 6:
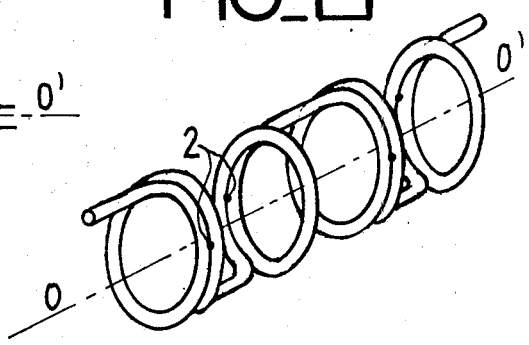

In this way a ring and bar line is obtained and FIG. 6 shows a perspective view of this line. There is preferably an electrical connection and a mechanical connection on each ring at the point where the one and a half contiguous turns constituting the ring is closed. These rings 2 are shown diagrammatically in FIG. 6.

Figure 7:
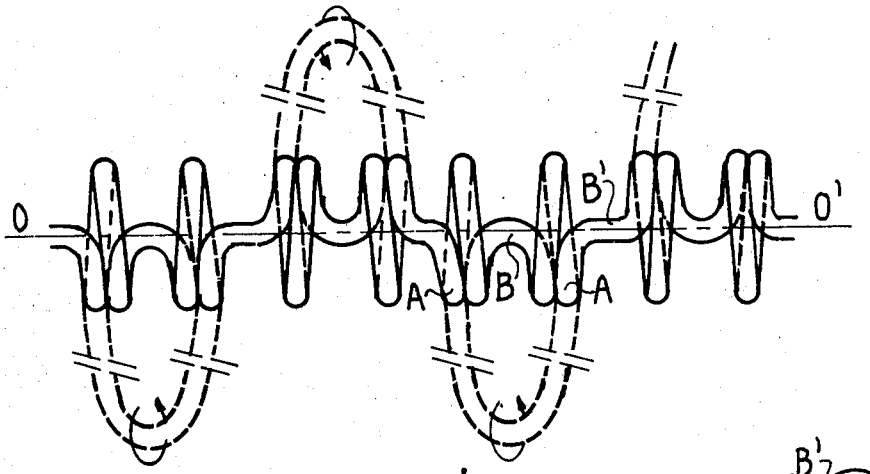

FIG. 7 is a diagram illustrating a third application of the manufacturing method according to the invention to a ring and bar-type delay line.

Figure 8:
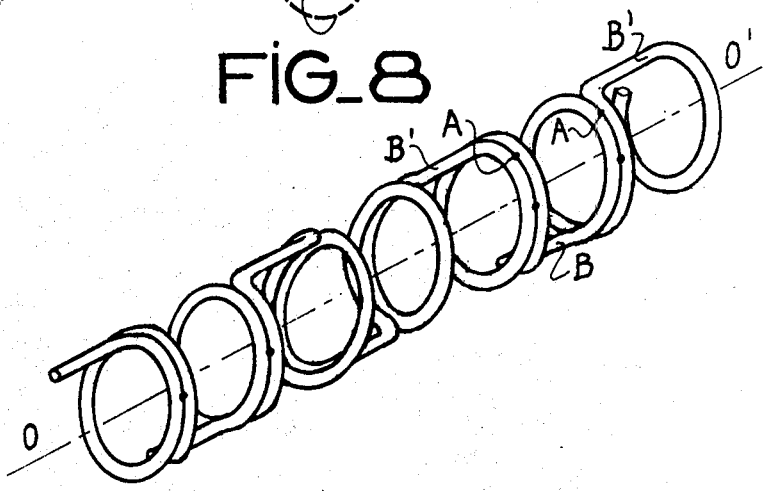

In this case the wire undergoes bending and two successive wire sections subjected to bending are arched in opposite directions. The wire sections which have undergone bending are shown by broken lines in FIG. 7. Between two wire sections which have undergone bending there is a wire section which is substantially parallel to axis 00', which constitutes a bar B'. Each bent wire section then undergoes coiling. During coiling each arc made during the bending process is coiled towards the axis of line 00' in such a way as to form two rings A of one and a half contiguous coils, which are joined by a wire section which is substantially parallel to the axis of the line, which forms a bar B. Two consecutive arcs are coiled towards the axis of line 00' in opposite directions. Thus, each arc which undergoes coiling constitutes two rings A separated by a bar B, said rings A being separated from other rings of the line by bars B'. Bars B and B' are diametrically opposed with respect to the rings. In this way a ring and bar line is obtained and FIG. 8 is a perspective view of this line. Here again it is preferable to have an electrical connection and a mechanical connection on each ring at the point where the one and a half contiguous coils constituting the ring is closed. These connections 2 are shown diagrammatically in FIG. 8.

The ring and loop-type delay lines can be obtained by using the application mode of the manufacturing method according to the invention illustrated by FIGS. 3, 5 and 7, provided that a cambering operation is added. Cambering consists of separating from the axis of line 00' by acting perpendicular thereto, the wire sections which are used as bars in ring and bar lines and which are arranged parallel to axis 00', whilst forming loops therefrom.

Figure 9:
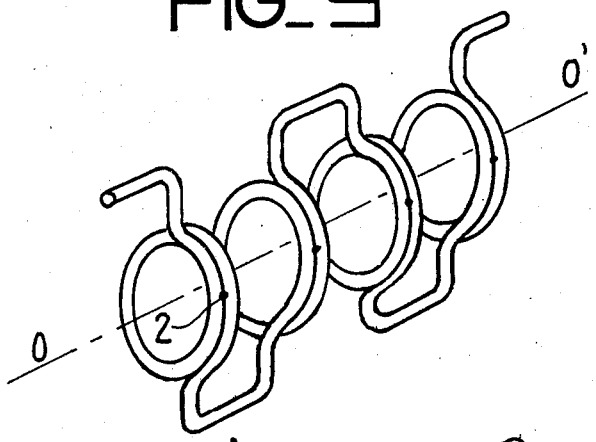
FIGS. 9, 10 and 11, perspective views of three variants of a ring and loop-type delay line obtained by the method of the invention.
Figure 10:
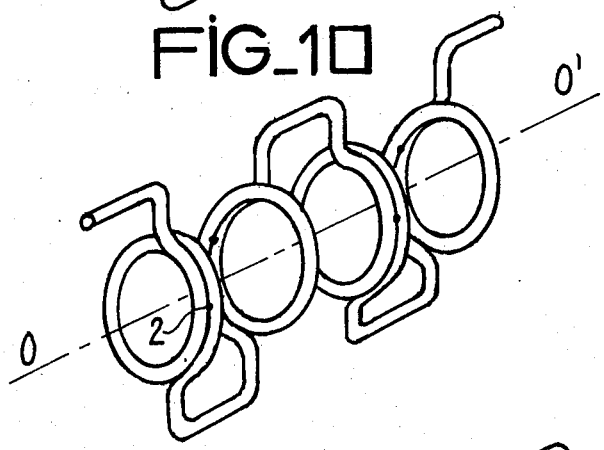
Figure 11:
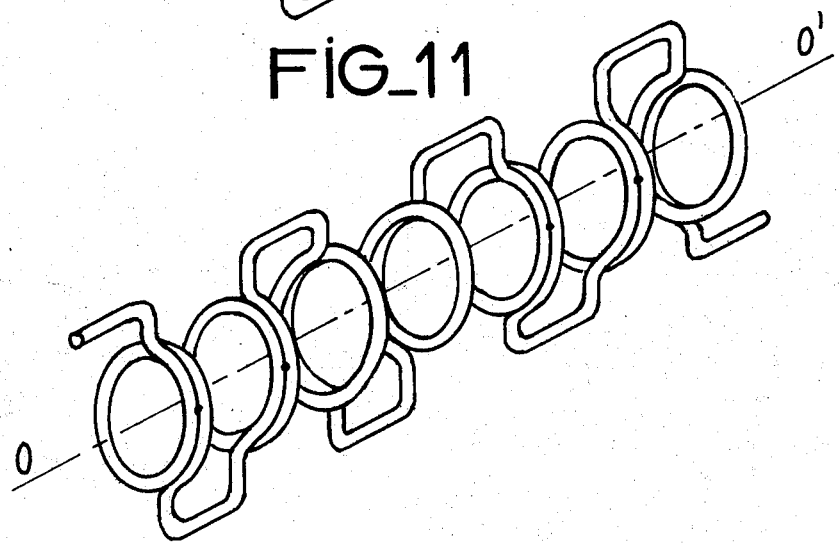

FIGS. 9, 10 and 11 are perspective views of three embodiments of ring and loop-type delay lines obtained by application modes of the method of the inventions illustrated by FIGS. 3, 5 and 7 and completed by a cambering operation.

The drawings show in exemplified manner a round wire, but it is obvious that the wire cross-section can be of a random nature and can in particular be rectangular or square. In the same way the period of the lines can vary, as can the shape of the coils and the coil development length.

What is claimed is:

1. A method for the manufacture of a microwave delay line which ensures, in a travelling wave tube, the interaction between an electron beam focussed in the axis of the line and the fundamental propagation mode of the hyperfrequency travelling wave traversing said line, with a phase velocity close to that of the beam, the amplitude of the inverse propagation mode of the wave being reduced compared with that of a helical microwave delay line, wherein it comprises using a single metal wire shaped into contiguous coils, these coils being deformed at regular intervals in a direction corresponding to the longitudinal axis of the coils, which constitutes the axis of the line, in such a way that the line is constituted by a succession of identical groups of three coils in which the first and third coils have substantially equal, but oppositely directed inclinations compared with the longitudinal axis of the coils and in which half of the second coil remains contiguous with the first coil and the other half remains contiguous with the thirds coil.

2. A method for the manufacture of a microwave delay line which ensures, in a travelling wave tube, the interaction between an electron beam focussed in the axis of the line and the fundamental propagation mode of the hyperfrequency travelling wave traversing said line, with a phase velocity close to that of the beam, the amplitude of the inverse propagation mode of the wave being reduced compared with that of a helical microwave delay line, wherein it comprises using a single metal wire which firstly undergoes the bending operation during which a substantially sinusoidal shape is given to wire sections, two successive wire section being arched in opposite directions, after which the wire undergoes the coiling operation during which each arc made by bending is coiled towards the axis of the line in such a way as to form two incomplete coils, each representing three-quarters of a coil and which are joined by a wire section which is substantially parallel to the axis of the line and which constitutes a bar, two consecutive arcs being coiled towards the axis of the line in opposite directions and after coiling, each arc constituting with the two arcs adjacent thereto two rings formed by one and a half contiguous coils arranged perpendicularly to the axis of the line, each ring being separated from the following ring by a bar and two consecutive bars being diametrically opposed with respect to the rings.

3. A method according to claim 2, wherein each wire section substantially parallel to the axis of the line is separated from said axis in a direction perpendicular thereto and forms a loop, two consecutive loops being diametrically opposed with respect to the rings.

4. A method for the manufacture of a microwave delay line which ensures, in a travelling wave tube, the interaction between an electron beam focussed in the axis of the line and the fundamental propagation mode of the hyperfrequency travelling wave traversing said line, with a phase velocity close to that of the beam, the amplitude of the inverse propagation mode of the wave being reduced compared with that of a helical microwave delay line, wherein the metal wire firstly undergoes the bending operation during which a substantially sinusoidal shape is given to sections of the wire, two successive sections of the wire being arched in opposite directions and one wire section substantially parallel to the axis of the line which constitutes a bar being arranged between two wire sections which have undergone bending, the wire then undergoes coiling during which each arc made during the bending process is coiled towards the axis of the line so as to form two rings of one and a half contiguous coils, arranged perpendicularly to the axis of the line and joined by a wire section substantially parallel to the axis of the line, which constitutes a bar, two consecutive arcs being coiled towards the axis of the line in opposite directions.

5. A method according to claim 4, wherein each wire section substantially parallel to the axis of the line is separated from said axis in a direction perpendicular thereto and forms a loop, two consecutive loops being diametrically opposed with respect to the rings.

6. A microwave delay line which ensures, in a travelling wave tube, the interaction between an electron beam focussed in the axis of the line and the fundamental propagation mode of the hyperfrequency travelling wave traversing said line at a phase velocity close to that of the beam, the amplitude of the inverse propagation mode of the wave being reduced compared with that of a helical hyperfrequency delay line, wherein it is obtained by the method according to claim 1 or 2, or 4.

* * * * *